US007119681B2

(12) United States Patent
Eskildsen

(10) Patent No.: US 7,119,681 B2
(45) Date of Patent: Oct. 10, 2006

(54) MEMS BASED GARAGE DOOR SENSOR

(75) Inventor: Kenneth G. Eskildsen, Great Neck, NY (US)

(73) Assignee: Honeywell International, Inc., Morristown, NJ (US)

( * ) Notice: Subject to any disclaimer, the term of this patent is extended or adjusted under 35 U.S.C. 154(b) by 119 days.

(21) Appl. No.: 10/842,930

(22) Filed: May 11, 2004

(65) Prior Publication Data

US 2005/0253710 A1 Nov. 17, 2005

(51) Int. Cl.
*G08B 13/08* (2006.01)

(52) U.S. Cl. ..... 340/545.5; 340/545.8; 340/545.1

(58) Field of Classification Search ..... 340/545.5, 340/545.8, 545.1, 546, 547, 548, 539.1, 545.2; 310/311

See application file for complete search history.

(56) References Cited

U.S. PATENT DOCUMENTS 6,046,562 A * 4/2000 Emil ..... 318/484
6,148,399 A * 11/2000 Lyke ..... 712/10
6,346,889 B1 * 2/2002 Moss ..... 340/686.1
6,724,316 B1 * 4/2004 Addy et al. ..... 340/686.1
6,940,405 B1 * 9/2005 Script et al. ..... 340/545.1

OTHER PUBLICATIONS

Analog Devices product brochure for MEMS Technology downloaded over the internet on May 11, 2004.
Analog Devices product brochure for ADXL202 Accelerometer downloaded over the internet on May 11, 2004.

* cited by examiner

*Primary Examiner*—Anh V. La
(74) *Attorney, Agent, or Firm*—Scully, Scott, Murphy & Presser, P.C.

(57) ABSTRACT

A MEMS based overhead garage door intrusion sensor for a security system, such as a residential/home security system, for detecting an intrusion through an overhead garage door. In one embodiment, a MEMS sensor accelerometer is mounted with a sensitive axis of the MEMS device, along which the MEMS device measures acceleration/gravity, pointing vertically downward towards the earth when the overhead garage door is closed, such that the MEMS sensor measures a 1 g acceleration/gravity force, and when the overhead garage door is open, the sensitive axis of the MEMS device points horizontally with respect to the earth, such that the MEMS sensor measures a 0 g acceleration/gravity force, such that the output of the MEMS sensor, indicating either a 1 g or a 0 g measured acceleration/gravity force, indicates whether the overhead garage door is respectively closed or open. Alternatively, the MEMS sensor can be a MEMS switch. An ASIC or microcontroller can monitor the output of the MEMS sensor, and one embodiment employs wireless RF technology.

20 Claims, 3 Drawing Sheets

MEMS BASED GARAGE DOOR SENSOR

BACKGROUND OF THE INVENTION

1. Field of the Invention

The present invention relates generally to a MEMS (micro-electro-mechanical system) based garage door sensor, and more particularly pertains to a MEMS based overhead garage door intrusion sensor for a security system, such as a residential/home security system, for detecting an intrusion through an overhead garage door.

2. Discussion of the Prior Art

The present invention addresses the commercial problem of a security system, such as a residential/home security system, detecting an intrusion through an overhead garage door. Existing prior art garage door intrusion sensor solutions to this commercial problem are problematic.

A first prior art approach for detecting an intrusion through an overhead garage door involves fixedly attaching a glass or plastic reed switch sensor enclosed in a relatively large metallic, non-magnetic (e.g. aluminum) housing to the garage floor, typically a concrete floor, with the housing being attached to a BX cable. Also, a magnet is then attached to the overhead garage door above the sensor, such that the reed switch senses movements of the magnet and garage door relative to the fixed relatively large and cumbersome metallic housing.

Another prior art approach for detecting an intrusion through an overhead garage door involves attaching a sensor having a glass enclosed mercury tilt switch to the overhead garage door, such that the mercury tilt switches senses changes in the angular position of the overhead garage door. This prior art approach presents a toxicity problem as mercury is a toxic substance, and the glass enclosure of the mercury tilt switch is susceptible to being broken with a consequential leakage of the toxic mercury.

SUMMARY OF THE INVENTION

The present invention provides a MEMS based overhead garage door intrusion sensor for a security system, such as a residential/home security system, for detecting an intrusion through an overhead garage door.

In one embodiment, the MEMS sensor is a MEMS accelerometer, and is mounted with a sensitive axis of the MEMS device, along which the MEMS device measures acceleration/gravity, pointing vertically downward towards the earth when the overhead garage door is closed, such that the MEMS sensor measures a 1 g acceleration/gravity force, and when the overhead garage door is open, the sensitive axis of the MEMS device points horizontally with respect to the earth, such that the MEMS sensor measures a 0 g acceleration/gravity force, such that the output of the MEMS sensor indicates whether the overhead garage door is closed or open. Alternatively, the MEMS accelerometer can be mounted with a sensitive axis of the MEMS sensor pointing horizontally when the overhead garage door is closed. One advantage of this embodiment is that the MEMS accelerometer can also serve as a crash detector, such that if a car is driven through the garage door, the MEMS accelerometer will measure an acceleration in the direction of the driven car. Alternatively, the MEMS sensor can be a MEMS switch. An ASIC or microcontroller can monitor the output of the MEMS sensor. One embodiment employs wireless RF technology.

One advantage of a MEMS sensor is that the operation of the MEMS sensor can be supervised, enabling the operability of the MEMS sensor to be checked. If the MEMS sensor is not functioning correctly, an error message can be sent to the security system control panel.

BRIEF DESCRIPTION OF THE DRAWINGS

The foregoing objects and advantages of the present invention for a MEMS based garage door sensor may be more readily understood by one skilled in the art with reference being had to the following detailed description of several embodiments thereof, taken in conjunction with the accompanying drawings in which.

DETAILED DESCRIPTION OF THE INVENTION

Figure 1:
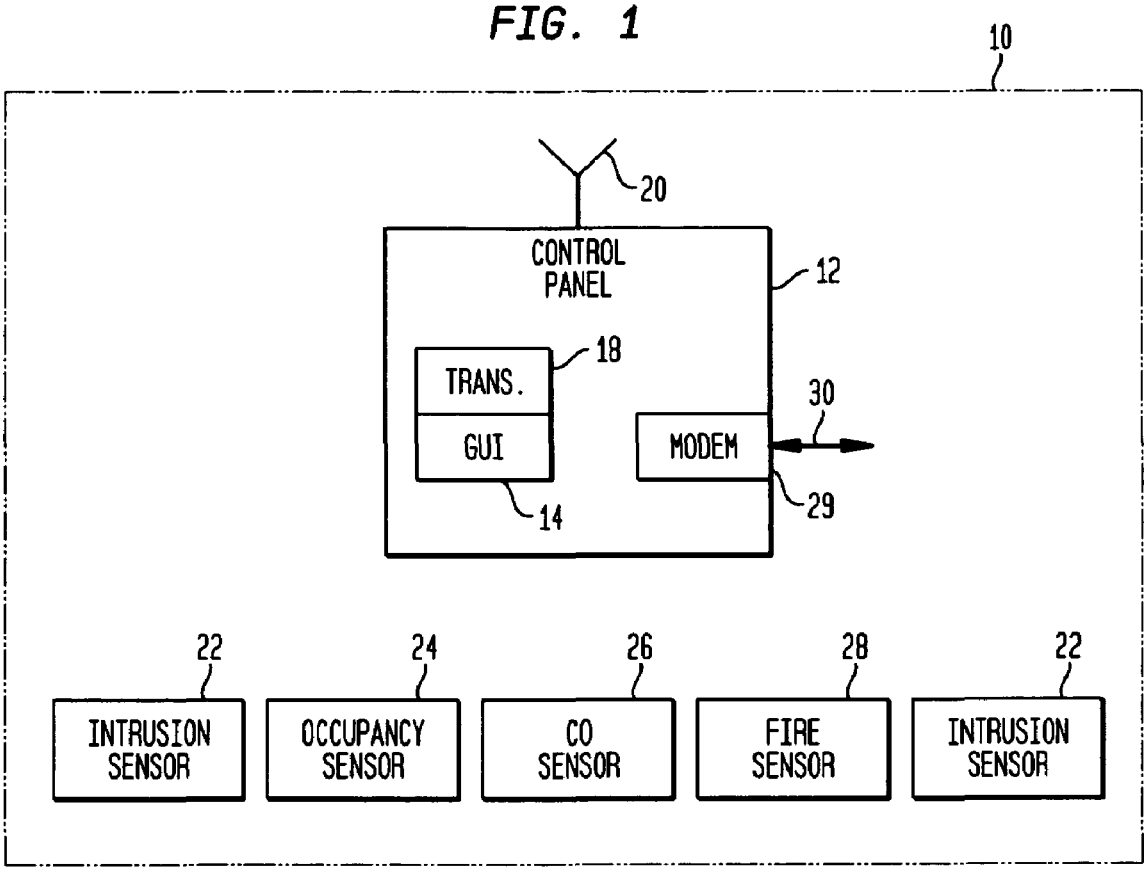
FIG. 1 illustrates a typical security system for a residential or commercial premises that comprises a security system control panel and different types of intrusion, occupancy and environmental condition sensors.

FIG. 1 illustrates a security system for a residential or commercial premises 10 that typically comprises a security system control panel 12 provided at a central accessible location, such as just inside the front entrance of the premises protected by the security alarm system. The control panel provides a person or homeowner with a display 14 of information on the complete status of the security system, such as a display of pertinent parameters and conditions of the security system.

The control panel also enables a person to control operation of the security system, such as arming or disarming of the security system by entry of a proper security code and of specific commands. The control panel might include a GUI display (graphical user interface) 14 to enable a user to view the status of the security alarm system and also to enter data into and access and control the security system.

The security system control panel also includes an RF transceiver 18 and antenna 20 to transmit and receive RF transmitted data, and the security system might be a wireless system, with many of the communications between sensors and the control panel being by short range RF communication messages.

Figure 2:
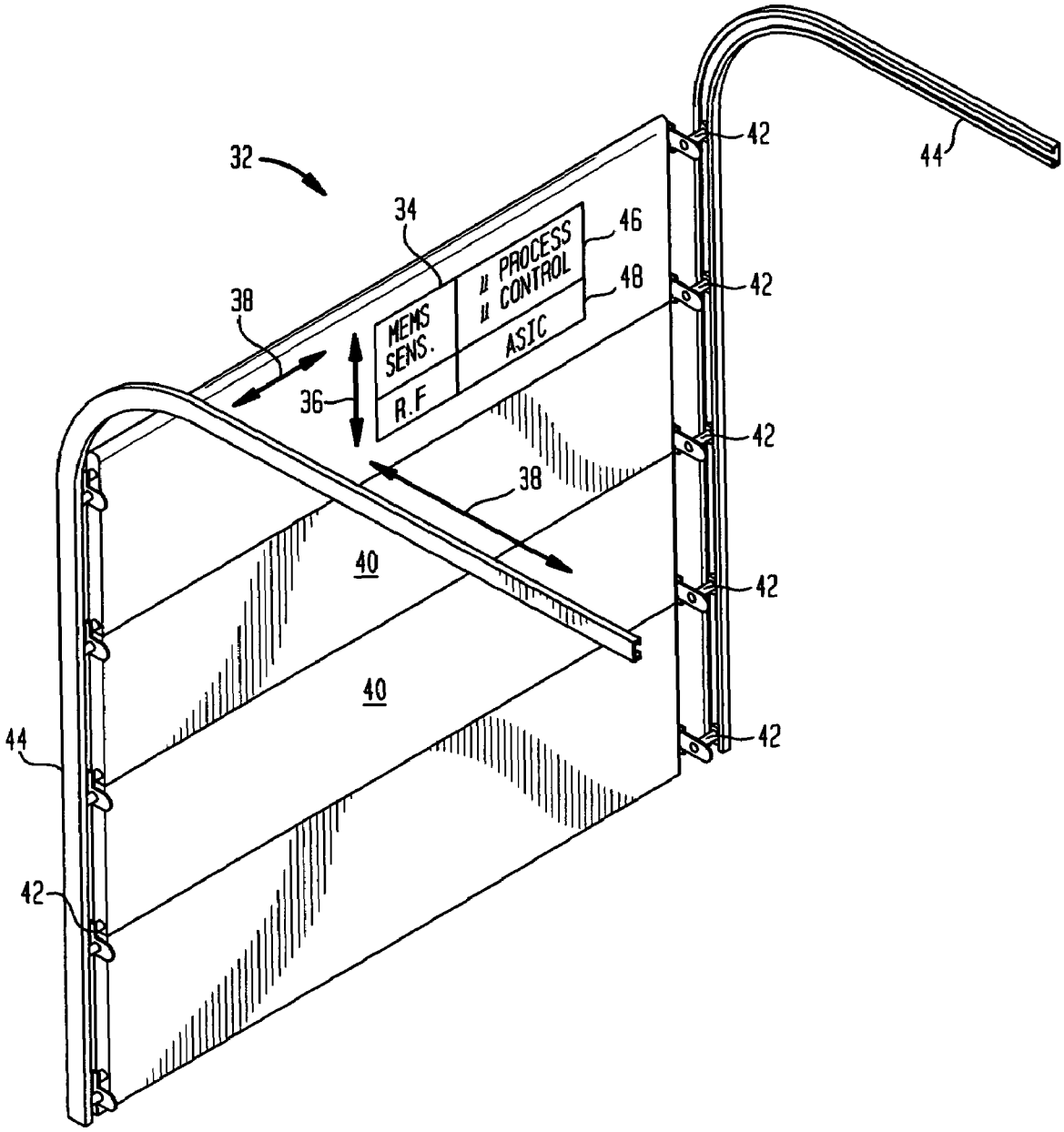
FIG. 2 illustrates an embodiment of the present invention that uses a MEMS (micro-electro-mechanical system) sensor to determine the orientation of an overhead garage door with respect to the earth.

A typical residential or commercial security system also includes a plurality of intrusion security sensors 22 mounted at doors, including an intrusion sensor mounted on an overhead garage door 32 as illustrated in FIG. 2, and windows to detect any intrusions thereat, and motion/occupancy sensors 24 mounted at strategic locations in the premises to detect the presence of a person thereat, which are connected by security system wiring to the security system control panel. A typical security system might also include one or more CO sensors 26 and smoke or fire sensors 28 mounted at strategic locations in the premises to detect any of those conditions in the premises, with those sensors also being connected by security system wiring or short range RF transmissions to the security system control panel. The security system control panel monitors signals from the security system sensors to determine the status of the security system.

A typical residential or commercial security system might also include a modem 29 and a telephone line or cable connection to allow bi-directional data communications over telephone lines and/or a cable system and/or the internet, as indicated schematically at 30.

Figure 3:
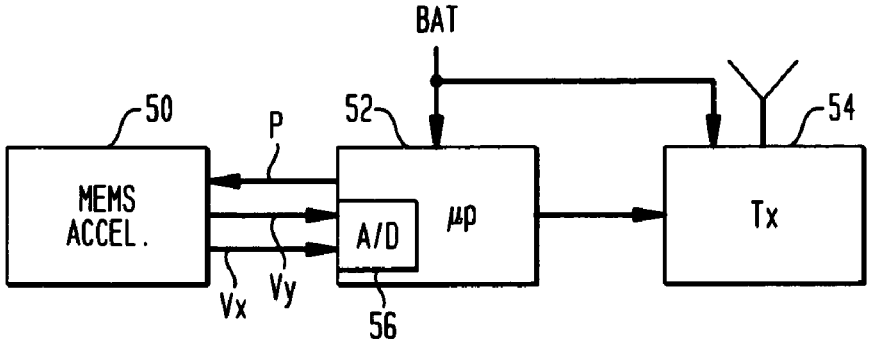
FIG. 3 illustrates an exemplary sensing circuit for a MEMS accelerometer sensor.
Figure 4:
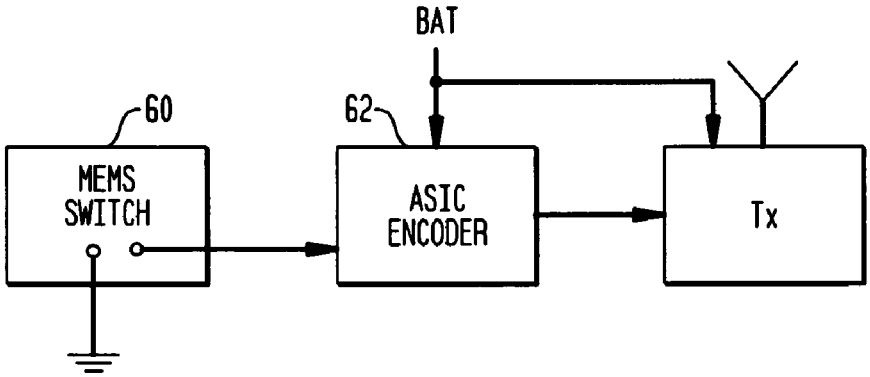
FIG. 4 illustrates an exemplary sensing circuit for a MEMS switch sensor.

Referring to FIG. 2, the present invention uses a MEMS (micro-electro-mechanical system) sensor 34, such as a MEMS static accelerometer, as shown in the sensing circuit of FIG. 3, or a MEMS switch, as shown in the sensing circuit of FIG. 4, to determine the orientation of an overhead garage door 32 with respect to the earth, wherein an orientation of the overhead garage door parallel to the earth is indicative of an open garage door and an alarm condition, and an orientation of the overhead garage door orthogonal to the earth is indicative of a closed garage door and a restore condition.

In the illustrated embodiment, the MEMS sensor 34 is mounted near the inside (to protect it from the outside elements) top (to maintain it in a more protected location) edge of the overhead garage door 32. In one embodiment, the MEMS sensor 34 is a MEMS accelerometer, and is mounted with the sensitive axis 36 of the MEMS device, along which the MEMS device measures acceleration/gravity, pointing vertically downward towards the earth, as illustrated by arrow 36, when the overhead garage door is closed, such that the MEMS sensor measures an approximately 1 g acceleration/gravity force. When the overhead garage door is open, the sensitive axis of the MEMS device, along which the MEMS device measures acceleration/gravity, is pointing horizontally with respect to the earth, such that the MEMS sensor measures a 0 g acceleration/gravity force. Accordingly, the output of the MEMS sensor, indicating either a 1 g or a 0 g measured acceleration/gravity force, indicates whether the overhead garage door is respectively closed or open.

Alternatively, the MEMS sensor can be mounted with the sensitive axis of the MEMS device pointing horizontally with respect to the earth, as illustrated by arrow 38, when the overhead garage door is closed, such that the MEMS sensor measures a 0 g acceleration/gravity force. When the overhead garage door is open, the sensitive axis of the MEMS device, along which the MEMS device measures acceleration/gravity, is pointing vertically downwards with respect to the earth, such that the MEMS sensor measures a 1 g acceleration/gravity force. Accordingly, the output of the MEMS sensor, indicating either a 0 g or a 1 g measured acceleration/gravity force, indicates whether the overhead garage door is respectively closed or open.

One advantage of this embodiment is that the MEMS accelerometer can also serve as a crash detector, such that if a car is driven through the garage door, the MEMS accelerometer will measure an acceleration in the direction of the driven car along arrow 38.

Figure 5:
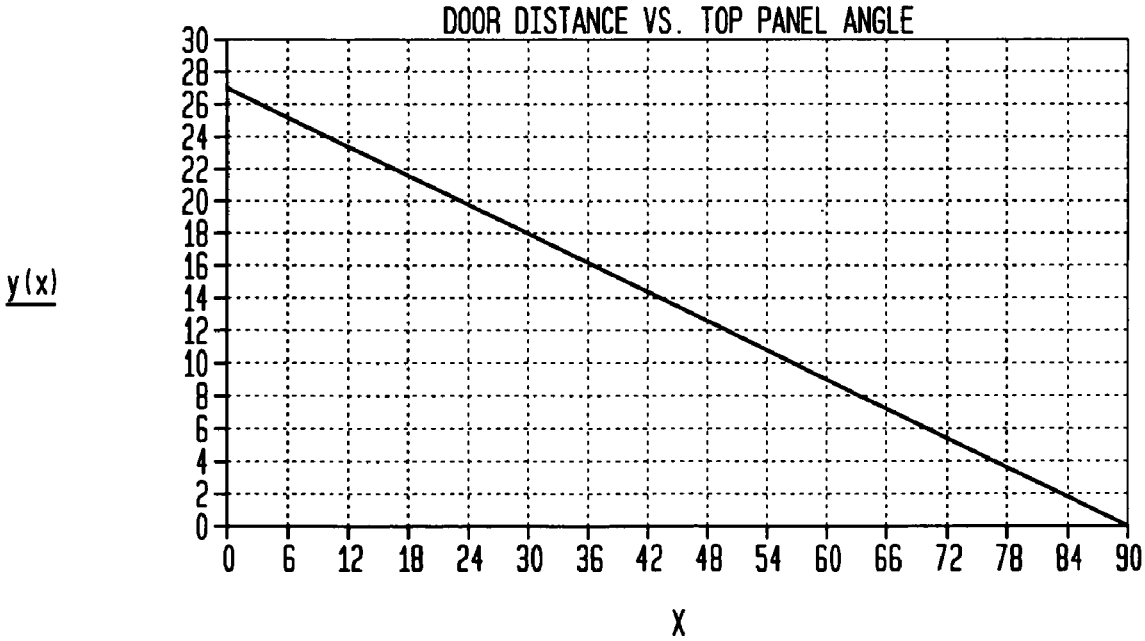
FIG. 5 is a graph of a garage door distance opening from the bottom of the garage door versus the angle of the top panel of the garage door in degrees.

In actual practice, a value between 0 g and 1 g will be measured by the MEMS accelerometer as the garage door travels from a fully vertical position to a fully horizontal position, as depicted by the graph of FIG. 5. In one embodiment, an alarm signal will be generated based upon a predetermined g value that is associated with a predetermined opening of the garage door, such as a 6 inch opening of the bottom of the garage door. In one particular embodiment, the 6 inch opening of the bottom of the garage door is associated with an angular position of approximately 70 degrees of the top panel of the garage door and a measurement of approximately 0.9 g by the MEMS sensor mounted on the top panel of the garage door.

Alternatively, the MEMS sensor can be a MEMS switch, as illustrated in the exemplary sensing circuit of FIG. 4. A MEMS switch measures its position relative to gravity similar to a Hg switch. A MEMS switch could incorporate a pivotally mounted weight that moves when the MEMS switch is tilted to short out two electrodes to complete an electrical circuit at a predetermined angular position of the MEMS switch.

The overhead garage door 32 is of a typical design, and includes a plurality of individual sectional door panels 40 which are pivotally mounted with respect to each other, and includes a plurality of hinge and roller mechanisms 42 mounted on opposite sides, with the rollers being positioned to travel in tracks 44, having both a vertical run and a horizontal run, positioned on opposite sides of the overhead garage door 10. In alternative embodiments, the garage door could be of a one piece pivotal swinging design or any other design known in the art.

One suitable sensor for use in the present invention is a MEMS static accelerometer, model ADXL202E, commercially available from Analog Devices Corporation. The MEMS static accelerometer, model ADXL202E, measures acceleration/gravity, and when mounted near the top of a garage door, depending upon whether the garage door is closed or open, is positioned to have a sensitive axis along which it measures acceleration/gravity oriented parallel to or orthogonal to the direction of gravity, such that the MEMS static accelerometer produces an output signal indicative of a force of 1 gravity or an output signal indicative of a force of 0 gravity depending upon its orientation on the garage door and whether the garage door is in an open or closed position.

The MEMS static accelerator, model ADXL202E, is a dual axis accelerometer that features a 2-axis acceleration/gravity sensor mounted on a single IC chip in a 5 mm×5 mm×2 mm chip package. Since the present invention needs to measure acceleration/gravity along a single axis, the second sensitive axis 38 of the sensor can be positioned to be oriented horizontally, as illustrated by arrow 38, in both the closed and open positions of the overhead garage door. Alternatively, an accelerometer having a single sensitive axis can be utilized in different embodiments.

The MEMS static accelerometer, model ADXL202E, is a low-cost, low-power, complete 2-axis accelerometer with a measurement range of ±2 g. The ADXL202E can measure both dynamic acceleration (e.g., vibration) and static acceleration (e.g., gravity). Its outputs are Duty Cycle Modulated (DCM) signals whose duty cycles (ratio of pulsewidth to period) are proportional to the measured acceleration/gravity along each of its two sensitive axes. It provides 2 mg resolution at 60 Hz, at a low power <0.6 mA, and can provide a direct interface to a low cost microcontroller/microprocessor 46 via a duty cycle output. Its outputs may be measured directly with a microcontroller/microprocessor counter, requiring no A/D converter or glue logic. The DCM period of the DCM signal is adjustable from 0.5 ms to 10 ms. An analog output signal proportional to acceleration is also available from separate XFILT and YFILT output pins, or may be reconstructed by filtering the duty cycle outputs.

In different embodiments, an ASIC (application specific integrated circuit) 48 or microcontroller/microprocessor 46 can be used to monitor the output of the MEMS sensor to determine its orientation with respect to the earth and generate an appropriate alarm or restore signal.

One preferred embodiment of the present invention employs wireless RF technology, with an RF transmitter or transceiver 49, such as is illustrated in FIG. 2.

One advantageous feature of the present invention is that operation of the MEMS sensor is supervised by the microcontroller/microprocessor or the ASIC, such that if the MEMS sensor becomes inoperative for some reason, the system becomes aware of the inoperability. The components 34, 46, 48 and 50 are illustrated with a very enlarged scale in FIG. 2 to show the printed letters, and in actuality those components would be very much reduced in size.

FIG. 3 illustrates an exemplary sensing circuit for a MEMS accelerometer sensor 50, such as the model ADXL202E, which is controlled by a microprocessor 52 which communicates with the security system by a transmitter Tx 54. The microprocessor 52 has a battery power supply BAT, and in a preferred embodiment periodically supplies electrical power over power line P to the power pin of 50 to periodically turn on and sample (e.g. sample once every second) the MEMS accelerometer output. The accelerometer produces an output Vy indicative of acceleration along the y axis and an output Vx indicative of acceleration along the x axis. The periodic sampling conserves the life of the battery power supply BAT (an estimated continuous Ima current would quickly drain the battery if left on). The Vy and Vx outputs are converted by an A/D converter 56 in the microprocessor to digital values which are then encoded by software for a periodic transmission by the Tx 54, also to save power.

FIG. 4 illustrates an exemplary sensing circuit for a MEMS switch 60, coupled to an ASIC encoder 62, coupled to a transmitter Tx 64. The MEMS switch does not have to be powered, and the ASIC 62 periodically senses the open or closed position of the MEMS switch 60, which encodes the position for a periodic transmission by the Tx 64, also to save power. The MEMS switch is preferably mounted such that its angular position is adjustable. For example, if the switch closed or opened at 70°, the angle of the MEMS switch can be prebiased at 60°, such that a 10° change in position is detected.

The following presents an analysis of garage door sensor sensitivity calculations.

These parameters are taken from the Analog Devices ADXL202E data sheet.

$$SpecVolt := 3\ \mathrm{V}$$

$$Sens_{min3v} := 140 \cdot \frac{\mathrm{mV}}{\mathrm{g}} \quad Sens_{max3v} := 195 \cdot \frac{\mathrm{mV}}{\mathrm{g}}$$

OperVolt:=3.3V Operating Voltage $$Corr := \frac{OperVolt}{SpecVolt} \quad Corr = 1.1$$

Correction Factor for 3.3 volt operation

Sensitivity at Operating Voltage $$Sens_{minOper} := Corr \cdot Sens_{min3v} \quad Sens_{minOper} = 154\ \frac{\mathrm{mV}}{g}$$

$$Sens_{maxOper} := Corr \cdot Sens_{max3v} \quad Sens_{maxOper} = 214.5\ \frac{\mathrm{mV}}{g}$$

$$G_{meas}(\theta) := g \cdot \sin\left(\frac{\pi}{180} \cdot \theta\right)$$

Equation for measured g force as a function of angle (θ) between the horizon and the sensor Linear Approximation of Top Panel Angle vs. Door Distance From the Ground x:=0, 1 . . . 90 m:=−0.3 Slope of the approximation—units are inches/degree b:=27 Y intercept—units are in inches y(x):=m·x+b Equation for door distance vs top panel angle y is the distance between the bottom of the door and the ground x is the angle between the horizion and the top garage door panel Rewritten $$x(y) := \frac{y-b}{m}$$

This equation relates the angle as a function of the door distance from the ground Units for x is degrees Units for y is inches $$Dist := 0, 1 \ldots 20$$

$$G_{meas}(dist) := g \cdot \sin\left(\frac{\pi}{180} \cdot x(dist)\right)$$

Calculate the G force that the sensor is subjected to as a function of the distance that the garage door has been opened from the ground.

FIG. 5 is a graph of a garage door distance opening from the bottom of the garage door versus the angle of the top panel of the garage door in degrees. For example, the angular mounting position of the MEMS sensor can be adjusted such that an alarm condition is annunciated when the garage door is opened such that the bottom of the garage door is 6 inches above its fully closed position.

One advantage of a MEMS sensor is that the operation of the MEMS sensor can be supervised by the microprocessor or ASIC, enabling the operability of the MEMS sensor to be checked. If the MEMS sensor is not functioning correctly, an error message can be sent to the security system control panel. For instance, the MEMS sensor can periodically energize a coil or plates in the MEMS sensor to create a field to move the sensor, to simulate movement or acceleration of the MEMS sensor. If the MEMS sensor is not operating properly, an error message would be sent to the control panel of the security system.

While several embodiments and variations of the present invention for a MEMS based garage door sensor are described in detail herein, it should be apparent that the disclosure and teachings of the present invention will suggest many alternative designs to those skilled in the art.

What is claimed is:

1. A garage door intrusion sensor for a security system comprising a MEMS (micro-electro-mechanical system) accelerometer attached to at least one panel of an overhead garage door to determine the orientation of the garage door with respect to the earth, wherein the measurement by the accelerometer of the earth's gravitational field indicates the angular position of the panel, which is interpreted to detect the position of the overhead garage door.

2. The garage door intrusion sensor of claim 1, in a security system having a security system control panel and intrusion, occupancy and environmental condition sensors, and wherein the MEMS accelerometer communicates with the security system control panel.

3. The garage door intrusion sensor of claim 1, in a wireless security system having a security system control panel including an RF transceiver to transmit and receive RF transmitted data, and the MEMS accelerometer including an RF transmitter for transmitting short range RF communication messages between the MEMS accelerometer and the control panel.

4. The garage door intrusion sensor of claim 1, wherein the MEMS accelerometer is mounted on the inside of the garage door panel to protect it from the outside elements and near the top of the garage door to provide a protected location.

5. The garage door intrusion sensor of claim 1, wherein an alarm condition is generated based upon a predetermined gravity value measured by the MEMS accelerometer that is associated with a predetermined angular position of the MEMS accelerometer as mounted on the garage door panel and a predetermined opening of the garage door.

6. The garage door intrusion sensor of claim 1, wherein the MEMS accelerometer output signal is input to a microprocessor/microcontroller, and the microprocessor/microcontroller periodically energizes the MEMS accelerometer, to conserve electrical power.

7. The garage door intrusion sensor of claim 1, wherein the MEMS accelerometer comprises a dual axis accelerometer mounted on a single IC chip package.

8. The garage door intrusion sensor of claim 1, wherein the system further comprises an overhead garage door that includes a plurality of individual sectional door panels which are pivotally mounted with respect to each other, and a plurality of hinge and roller mechanisms mounted on opposite sides of the overhead garage door, with the rollers being positioned to travel in tracks positioned on opposite sides of the garage door.

9. The garage door intrusion sensor of claim 1, wherein the MEMS accelerometer comprises a MEMS switch.

10. The garage door intrusion sensor of claim 9, wherein the position of the MEMS switch is adjustable to pre:bias the position of the MEMS switch.

11. The garage door intrusion sensor of claim 9, wherein the MEMS switch is coupled to an ASIC (application specific integrated circuit) that generates an alarm signal or a restore signal.

12. The garage door intrusion sensor of claim 11, wherein the MEMS switch is not supplied with electrical power, and the ASIC senses the open or closed position of the MEMS switch.

13. The garage door intrusion sensor of claim 1, wherein operation of the MEMS accelerometer is supervised, enabling the operability of the MEMS accelerometer to be checked, and if the MEMS accelerometer is not functioning correctly, an error message is sent to a security system control panel.

14. The garage door intrusion sensor of claim 13, wherein the MEMS accelerometer includes an element to produce an electromagnetic field, which is periodically energized to simulate operation of the MEMS accelerometer.

15. The garage door intrusion sensor of claim 1, wherein the MEMS accelerometer output signal is input to a microprocessor/microcontroller, and the microprocessor/microcontroller periodically energizes the MEMS sensor, to conserve electrical power.

16. The garage door intrusion sensor of claim 1, wherein the MEMS accelerometer is coupled to an ASIC (application specific integrated circuit) that generates an alarm signal or a restore signal.

17. The garage door intrusion sensor of claim 1, wherein the MEMS accelerometer output signal is input to a microprocessor/microcontroller that generates an alarm signal or a restore signal.

18. A garage door intrusion sensor for a security system comprising a garage door and a MEMS (micro-electro-mechanical system) sensor attached to the garage door to determine the orientation of the garage door with respect to the earth, wherein an orientation of the overhead garage door parallel to the earth is indicative of an open garage door and an alarm condition, and an orientation of the overhead garage door orthogonal to the earth is indicative of a closed garage door and a restore condition, wherein the MEMS sensor is a MEMS accelerometer mounted with a sensitive axis of the MEMS accelerometer, along which the MEMS accelerometer measures acceleration/gravity, pointing vertically downward towards the earth when the overhead garage door is closed, such that the MEMS accelerometer measures a 1 g acceleration/gravity force, and when the overhead garage door is open, the sensitive axis of the MEMS accelerometer points horizontally with respect to the earth, such that the MEMS accelerometer measures a 0 g acceleration/gravity force, such that the output of the MEMS accelerometer, indicating either a 1 g or a 0 g measured acceleration/gravity force, indicates whether the overhead garage door is respectively closed or open.

19. A garage door intrusion sensor for a security system comprising a garage door and a MEMS (micro-electro-mechanical system) sensor attached to the garage door to determine the orientation of the garage door with respect to the earth, wherein an orientation of the overhead garage door parallel to the earth is indicative of an open garage door and an alarm condition, and an orientation of the overhead garage door orthogonal to the earth is indicative of a closed garage door and a restore condition, wherein the MEMS sensor is a MEMS accelerometer mounted with a sensitive axis of the MEMS accelerometer, along which the MEMS accelerometer measures acceleration/gravity, pointing horizontally with respect to the earth, such that when the overhead garage door is closed the MEMS accelerometer measures a 0 g acceleration/gravity force, and when the overhead garage door is open, the sensitive axis of the MEMS accelerometer points vertically downwards with respect to the earth, such that the MEMS accelerometer measures a 1 g acceleration/gravity force, such that the output of the MEMS accelerometer, indicating either a 0 g or a 1 g measured acceleration/gravity force, indicates whether the overhead garage door is respectively closed or open.

20. The garage door intrusion sensor of claim 19, wherein the MEMS accelerometer also serves as a crash detector, such that if a car is driven through the garage door, the MEMS accelerometer will measure an acceleration in the direction of the driven car.

* * * * *